United States Patent [19]

Nakamura

[11] 4,078,738

[45] Mar. 14, 1978

[54] AUTOMATIC WINDING MACHINE FOR ROLLED TOWEL

[75] Inventor: Yoshizo Nakamura, Takamatsu, Japan

[73] Assignee: Tokai Mengyo Co., Ltd., Takamatsu, Japan

[21] Appl. No.: 768,620

[22] Filed: Feb. 14, 1977

Related U.S. Application Data

[63] Continuation-in-part of Ser. No. 663,495, Mar. 3, 1976, abandoned.

[30] Foreign Application Priority Data

Jul. 9, 1975 Japan ..... 50-55680

[51] Int. Cl.[2] ..... B65H 17/02; B65H 25/04

[52] U.S. Cl. ..... 242/67.1 R; 242/57; 242/65

[58] Field of Search ..... 242/67.1 R, 65, 66, 242/55, 57

[56] References Cited

U.S. PATENT DOCUMENTS

| | | | |
|---|---|---|---|
| 2,859,814 | 11/1958 | Berney | 242/57 |
| 3,097,806 | 7/1963 | Dorman | 242/57 |
| 3,133,712 | 5/1964 | Pano | 242/66 |
| 3,222,006 | 12/1965 | Bohnsen | 242/67.1 R |
| 3,695,540 | 10/1972 | Grantham | 242/65 |

*Primary Examiner*—Edward J. McCarthy
*Attorney, Agent, or Firm*—Fleit & Jacobson

[57] ABSTRACT

An automatic winding machine for a rolled towel in which a towel winding shaft and a friction roll are journalled respectively above and below a driving shaft horizontally journalled in an upper part of a machine frame. A horizontal bar is mounted on an arm lever in such a way that it freely makes contact with said friction roll, and thereby forces the towel onto the lower portion of said friction roll. Two sets of photosensitive units are mounted at the right and left sides of the machine frame in such a way that the rising towel is guided between the respective light sources and phototubes of each photosensitive unit. A timer is commonly connected to the contacts of the right and left phototubes, and the contact of a relay is connected with the delay contact of said timer in such a way that the machine is automatically stopped when a folded or torn portion of a towel is detected.

6 Claims, 9 Drawing Figures

AT WINDING TIME

BEFORE WINDING

AUTOMATIC WINDING MACHINE FOR ROLLED TOWEL

BACKGROUND OF THE INVENTION

This is a continuation-in-part of U.S. patent application Ser. No. 663,495, filed Mar. 3, 1976, abandoned.

Rolled towels used in washrooms or the like are usually wound by means of a winding machine after they are washed. Such a winding operation is necessarily performed in the presence of an operator who must observe the towel winding operation because towels normally contain patchedup parts and folded parts which require manual straightening during the winding process on a winding machine, as well as tears in the towel. As a result, a towel winding operation is hard to perform on an automatic machine. An object of the present invention is to provide a towel winding machine that automatically stops when patched and folded parts, as well as torn parts, are detected, to make it possible for these abnormal portions of the towel to be manually corrected before continued operation of the winding machine, thus saving labor expense.

SUMMARY OF THE INVENTION

The invention relates to an automatic winding machine for a rolled towel in which a towel winding shaft and a friction cylinder are journalled respectively above and below a driving shaft, which is horizontally journalled in an upper part of the machine frame. A horizontal upper holding bar is mounted on an arm lever in such a way that movement of the arm lever moves the upper holding bar freely into contact with the friction cylinder and thereby forces the towel onto the lower portion of the friction cylinder. Two sets of photosensitive units are mounted, one set each at the right and left part of the machine frame, in such a way that the rising towel is guided between the respective light sources and phototubes of said photosensitive units to detect a folded or torn side edge portion of a towel. Detection of a folded or torn towel actuates a timing relay, which in turn automatically stops the towel winding operation after a predetermined short period of time. This enables an operator to manually correct the fold before resuming the winding operation.

It is an object of this invention to provide a fully automated towel winding machine for winding towels on a roll. More particularly, it is an object of this invention to provide a fully automated towel winding machine that winds towels on a roll so that the wound towel is free of folded portions, and free of rips or tears in the side edges of the towel.

It is further an object of this invention to provide a towel winding machine with an automatic shut-off control system that automatically stops the winding operation when a folded or torn side edge portion of a towel is detected. It is still further an object of this invention to detect the folded or torn side edge portion of a towel by a photodetector system that senses the folded or torn portion of the towel and then automatically stops the towel from being wound, thus allowing an operator to correct the towel winding.

DETAILED DESCRIPTION OF THE DRAWINGS

Figure 1:
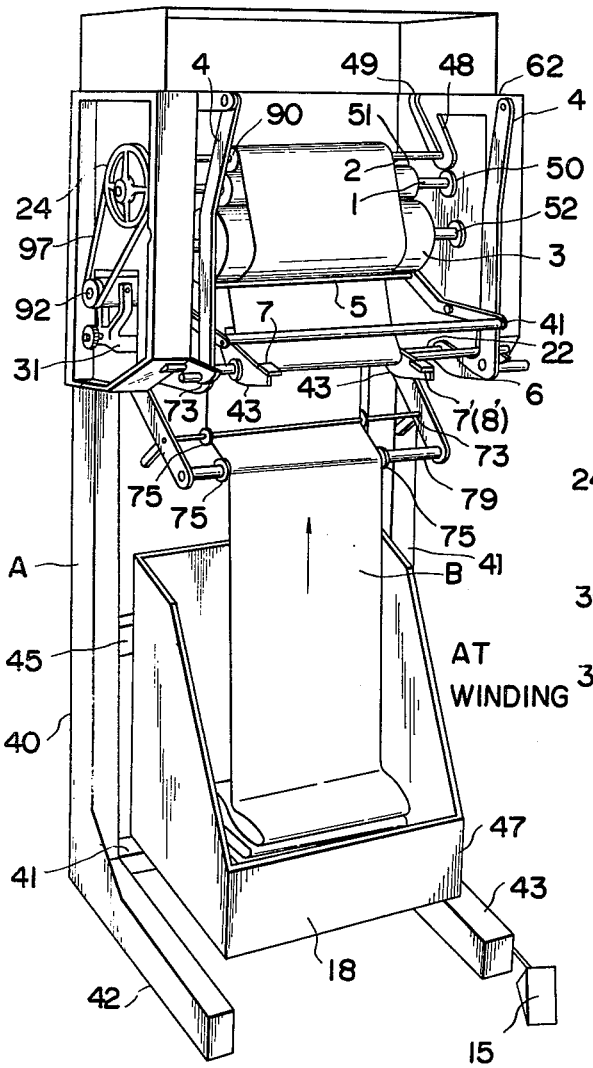
FIG. 1 is a perspective front view of the towel winding machine according to the present invention as shown during its winding stage.

The towel winding machine of the present invention comprises a machine frame A within which the winding apparatus is provided. The frame comprises a pair of vertically upstanding members 40, 41 arranged on a base comprising members 42 and 43. The two vertical upstanding members 40 and 41 are interconnected by a plurality of support beams 44, 45 and 46. Mounted near the bottom of the frame is a towel box 47 which can be of any desired shape so long as it is sufficiently sized to accommodate a folded towel B which is to be wound by the winding mechanism of the invention.

The towel B is wound upon a towel winding shaft 2. The towel winding shaft comprises a rod with suitable means for retaining the towel thereon. The shaft 2 is connected at both ends to a supporting member 48 in the upper part of the machine frame. The supporting member 48 is angularly disposed rearward and has a groove 49 therein. It should be appreciated from the perspective of FIG. 1 that while only one supporting member 48 with a groove 49 is shown, there is provided a similar member on the opposite end of the winding shaft 2. The towel to be wound is secured to a roller 90 mounted on the winding shaft 2 and the winding shaft 2 is adapted to rotate within the groove 49. As the towel is wound upon the roller 90 of the winding shaft 2, the shaft 2 not only moves rotatably to wind the towel, but also moves transversely within the groove 49. As the diameter of the wound towel increases, the shaft can move along the groove to accommodate the larger diameter rolled towel.

Positioned below the winding shaft 2 is a drive shaft 1. The drive shaft 1 is journalled in a bearing 50 to the frame at one end, and is connected to a pulley 24 at its other end. The pulley 24 is rotated by suitable electric motor means, to be described below. The rotation of the pulley provides rotation to the roller 90 of the drive shaft 1. A drive roller 51 is mounted on the drive shaft 1. The drive roller 51 of the drive shaft 1 is disposed relative to the roller 90 of the winding shaft so that the periphery of the roller drive shaft makes frictional contact with the roller of the winding shaft 2, or a towel that is wound upon the roller of the winding shaft 2.

Positioned slightly below the drive shaft 1, is a friction cylinder 3 mounted on a friction shaft 52. The friction shaft 52 is rotatably journalled in bearings to the frame. The outer periphery of the friction cylinder 3 engages the outer periphery of the drive roller 51 on the drive shaft 1, and is rotated thereby. The friction cylinder 3 makes frictional contact with the towel as the towel is pressed, against the friction cylinder 3 at its underside portion in a manner to be described below.

Figure 6:
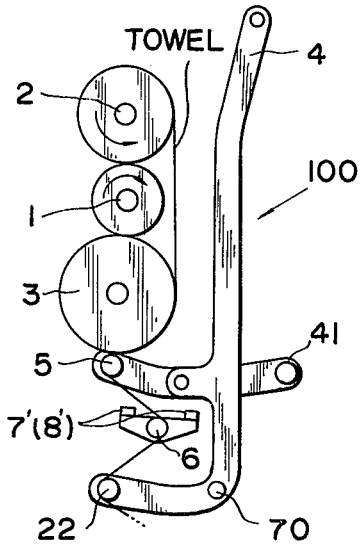
FIG. 6 is a schematic cross-section view of the towel holding shaft assembly in operation during winding.
Figure 7:
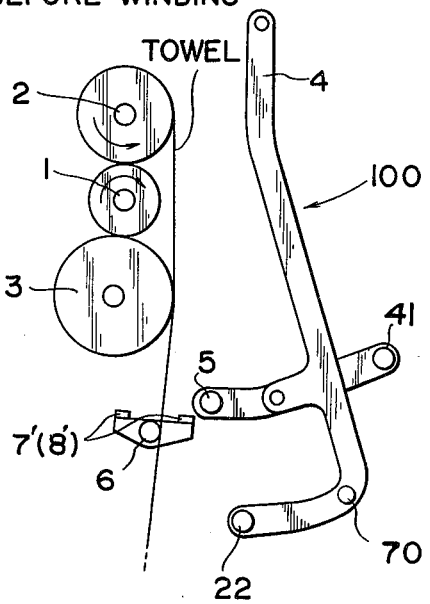
FIG. 7 is a schematic cross-sectional view of the towel holding shaft assembly before winding.
Figure 8:
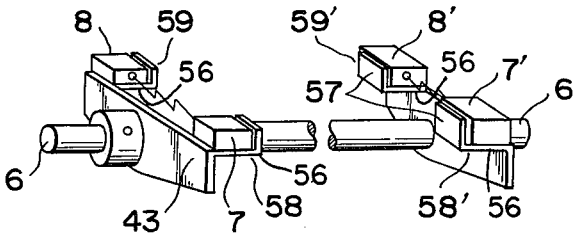
FIG. 8 is a perspective view of the photocell mounting arrangement of the present invention.

Mounted to the frame in a position below the friction shaft 3 is a stationary shaft 6 upon is mounted the photocell system 7, 8, and 7', 8'. FIG. 8 is a perspective view of the shaft 6 with the photocell mounting elements thereon. The position of the stationary shaft 6 relative to the friction cylinder 3 is also shown in FIGS. 6 and 7. The stationary shaft 6 is fixedly mounted to the frame at both ends, and extends substantially parallel to the winding shaft 2, drive shaft 1, and friction shaft 52. Mounted at each end of the shaft 6 are mounting plates 43. The mounting plates extend substantially perpendicular to the shaft 6, and each mounting plate has a pair of L-shaped mounting stands 58, 59 and 58', 59' extending therefrom. The mounting stands comprise L-shaped brackets having a horizontal portion 56 which extends toward the interior center line of the frame, and a vertical portion 57 which extends upward toward the top of the frame. Mounting stands 58 and 58' are mounted at a position outwardly of the rear of the frame, while mounting stands 59 and 59' are positioned rearwardly nearer the upstanding vertical members 40. Mounted on mounting stands 58 and 58' are light sources 7 and 7'. Mounted on the mounting stands 59 and 59' are photocell detectors 8 and 8'. Light source 7 is in light communication with photodetector 8, and light source 7' is in light communication with photocell detector 8'. When the source 7 is allowed to communicate with the detector 8, a suitable timer mechanism, to be described below, is actuated. The photocell systems 7 and 8 is designed so that the detector 8 is actuated only by receiving light from the light source 7. Light source 7 is a relatively coherent light source, so that is will not accidently actuate photodetector 8'.

Figure 2:
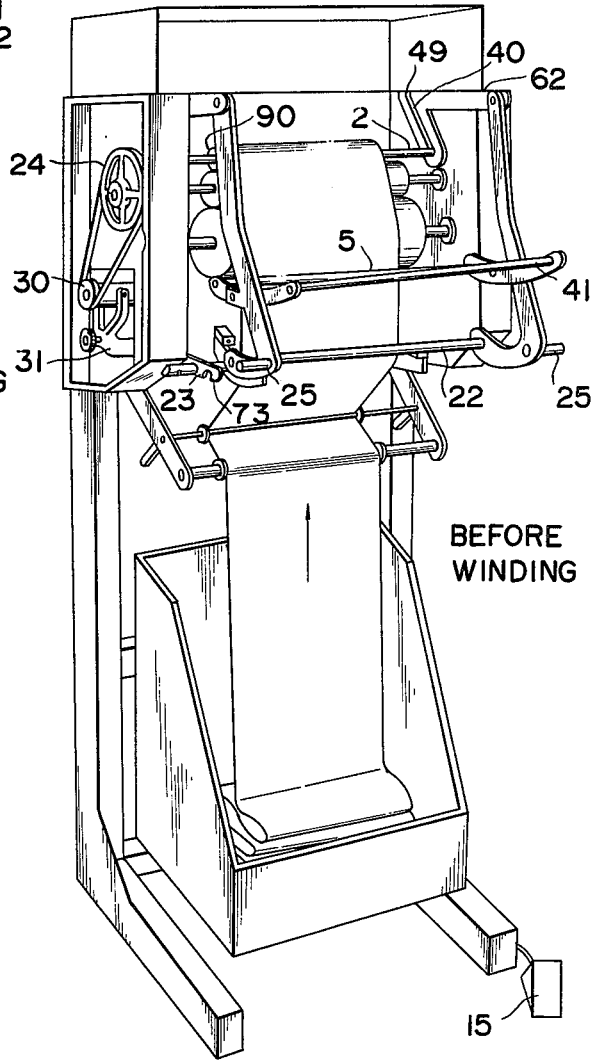
FIG. 2 is a perspective front view of the towel winding machine according to the present invention as shown in its before winding stage.
Figure 5:
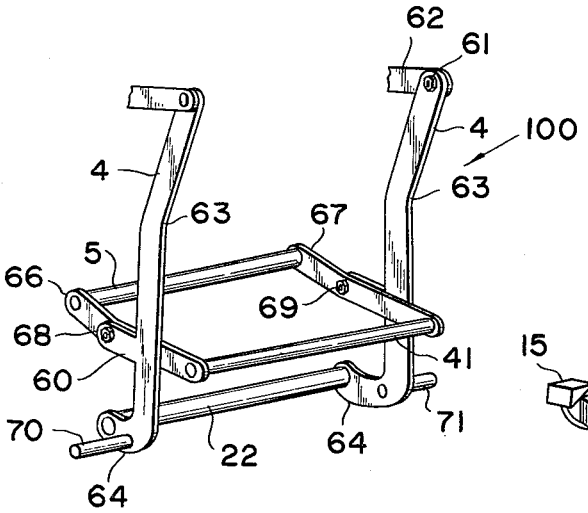
FIG. 5 is a perspective view of the towel holding shaft assembly of the present invention.

The towel B is engaged against the friction cylinder 3 by means of a towel holding assembly indicating generally as element 100 in FIG. 5. The towel holding assembly comprises a pair of vertically supported lever arms 4, each engaged for pivotal rotation around an end 61 of the lever arm 4. The end 61 of the lever arms are pivotally mounted by a suitable nut and bolt assembly to an extension arm 62 mounted in the top of the frame, and above the winding shaft 2. As shown in FIGS. 1 and 2, the extension member 62 is formed as an extension of support member 48, and extends at an acute angle therefrom substantially parallel to the horizontal. The lever arms 4 extend downwardly having a slight angle bend at point 63 with a curved bottom portion 64 extending at substantially right angles to the lever arm 4, and rearwardly toward the rear of the frame A. Extending between the two curved bottom portions 64 of the lever arm 4 is a lower towel holding shaft 22 which is adapted to extend the towel in a certain manner to be described below.

Approximately ⅓ of the way upward from the curved end 64 of the lever arm 4 is a substantially perpendicular and rearward extension 60. The extension 60 has an opening 68 at its end and is adapted to receive a nut and bolt assembly 69 for fixedly connecting an upper towel holding shaft 5. The upper towel holding shaft 5 has a pair of bars 66 and 67 perpendicularly fixed at both ends. A handle bar gripping shaft 41 is substantially parallel to the upper towel holding shaft 5 and extends between the ends of bars 66 and 67 at their opposite ends. Thus, the upper towel holding shaft 5, the bars 66 and 67, and the handle bar 41 form a rigid rectangular frame structure that is secured to the extension 60 of the lever arms 4 by a nut and bolt assembly 69. It should be noted that the frame structure comprising the upper holding member 5 and the handle bar member 41 may be adjusted to be fixedly set at different angular positions with respect to the lever arms 4. Mounted on the bottom portion of the lever arms 4, are a pair of rods 70 and 71 which serve to retain the holding assembly in a position where it engages a towel, as shown in FIG. 1. Suitable latch members 73 are provided on the frame of the winding machine and serve to engage the rods 70 so that the upper and lower towel holding shafts 5 and 22 are retained against the towel, in a manner to be described below.

FIGS. 6 and 7 depict schematically the relative position of the holding assembly 100 during a towel winding operation and in a releasing position (FIG. 7), before the towel winding begins. In operation, a towel to be wound is placed in the towel box 47 and a towel end is raised upward by an operator for engagement on the winding shaft 2. When the towel is to be wound, an operator will move the handle bar shaft 41 downward and inward in a manner as shown in FIGS. 6 and 7 so that the upper towel holding member 5 forces the towel against the friction cylinder 3. The upper towel holding member 5 is designed so that is makes contact with the friction cylinder 3. Thus, the insertion of the towel between the holding member 5 and the cylinder 3 results in the towel to be tightly compressed on the periphery of friction cylinder 3. The lower towel holding member 22 stretches the towel so that it fits tightly around the stationary shaft 6. In the position shown in FIG. 6, the upper towel holding member 5 firmly places the towel adjacent to the friction cylinder 3 on the bottom and rearward sector of the cylinder 3, and the holding shafts 5 and 22 stretch the towel tightly around the stationary shaft 6 so that the towel is closely adjacent to the photo elements 8 and 8'. The side edges of the towel blocks the light communication between the photo source 7 and the detector 8.

The frame structure A also comprises a plurality of guiding shafts, such as those shown in 73 and 74 which assists in guiding the towel upward onto the winding mechanism. Associated with shafts 73 and 74 are a plurality of guides 75 which serve to center the towel as it is wound upward.

Figure 4:
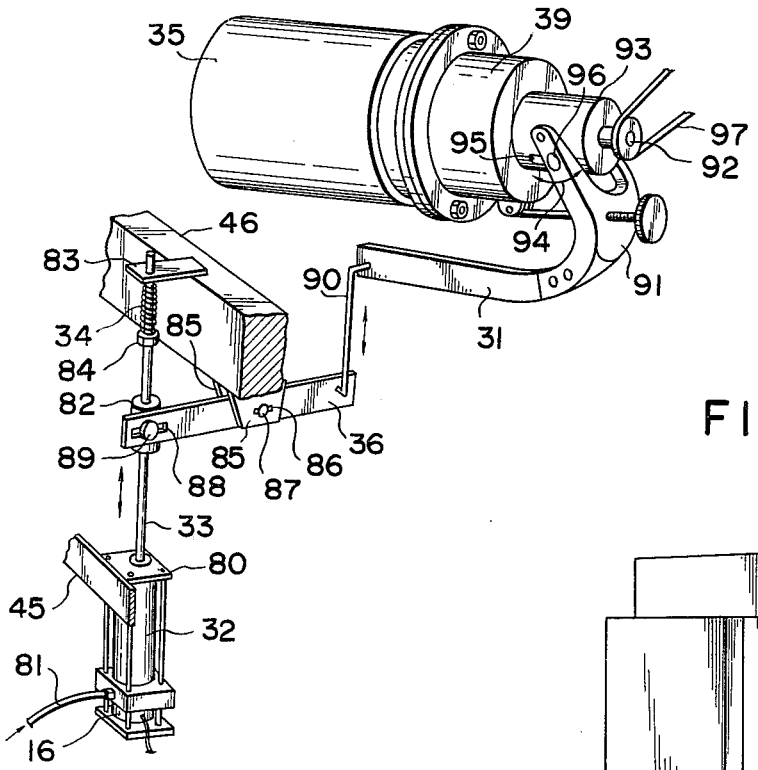
FIG. 4 is a perspective view showing assembly details for actuating the motor of the present invention.
Figure 3:
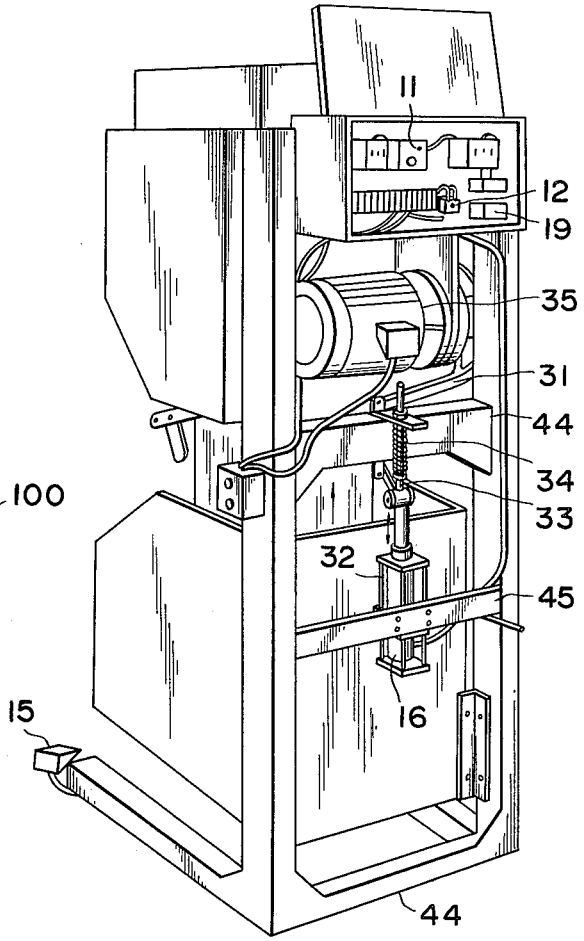
FIG. 3 is a perspective rear view of the towel winding machine of the present invention.

As discussed above, the drive shaft 1 is rotated by means of an electric motor arrangement that rotates the pulley 24. FIGS. 3 and 4 depict the drive mechanism for rotating the drive shaft 1. Mounted on the back side of the frame structure and fixedly connected to the cross bar 45 is an air cylinder 32. The air cylinder 32 is connected by means of a bracket 80 to the cross bar 45. On the bottom portion of the air cylinder 32 is a solenoid or magnetic valve arrangement 16. Actuation of the solenoid 16, in a manner to be described below, opens a valve providing a fluid source, such as an air source 81 to provide air under pressure to the air cylinder 32. Within the air cylinder 32 is a piston, (not shown), which is connected to an air cylinder rod 33. The air cylinder rod 33 is adapted to move vertically and is fixedly connected to a cylindrical attaching sleeve 82. The rod 33 extends through the cylindrical attaching sleeve 82 and is fixedly mounted to a plate 83, which in turn is fixedly connected to the cross bar element 46. A spring 34 surrounds the rod 33 at its upper extremity and is tensioned between the plate 83, and a nut 84 surrounding the rod 33. Thus, movement of the rod 33 in a vertical direction compresses the spring 34 between the plate 83 and the nut 84.

Pivotally mounted to the underside of cross arm 46 is a lever 36. The lever 36 pivots approximately around its midpoint on the underside of the cross bar 46. The lever 36 is pivotally connected to the cross bar 46 by means of a pair of downwardly parallel extending plates 85 mounted on either side of the lever arm 36. The side face of the plates 85 include a slot 86 which slidably receives a bolt 87 which is connected to the lever arm 36. One end of the lever arm 36 is interconnected to the cylindrical attaching sleeve 82. This interconnection comprises a slot 88 at one end of the lever 36 which slides about a pin 89 connected to the cylindrical attaching sleeve 82. The other ends of the lever arm 36 is connected with a link member 90. Link member 90 is substantially perpendicular to the lever 36 and connects to an arm 31. The arm 31 has an upper U-shaped portion 91. Within the U-shaped portion 91 extends the drive shaft 92 of a clutch motor 35. The drive shaft 92 is surrounded by a housing 93. A clutch 39 is provided on the clutch motor 35 and is actuated by movement of the U-shaped member in a manner as indicated by the arrow 94 in FIG. 4. A slot 95 is provided in the housing 93 and is adapted to receive an extension 96 mounted on the U-shaped member 91. The member 96 moves within the slot and is connected to the clutch mechanism for enabling and disabling the clutch. Actuation of the clutch provides drive power from the clutch motor to the shaft 92 which in turn moves the belt 97 to drive the pulley 24, which in turn drives the drive shaft 1. It should be noted that while actuation of the motor is provided by a clutch arrangement, any suitable motor can be used along with any suitable actuation means.

The actuation of the clutch motor assembly is as follows. When the solenoid 16 is actuated, in a manner to be described below, a valve, not shown is opened by the solenoid 16 to provide air flowing through air source 81 into the air cylinder 32. This in turn causes the air cylinder rod 33 to extend in an upward manner against the force of the spring 34. Movement of the air cylinder rod 33 in an upward manner results in the pivoting of lever arm 36 about point 87, which in turn provides for the linkage 90 to move downward. The downward movement of linkage arm 90 results in movement of arm 31 in a downward direction, which in turn moves the U-shaped portion 91 of the arm 31 in a substantially horizontal direction. Pin 96 attached to the portion 91 moves toward the left as shown in FIG. 4 and engages the clutch mechanism which in turn provides motor power to the pulley arrangement. When the solenoid 16 is deactivated, the air source 81 is closed and an air valve outlet opening, not shown, is provided to expel the air from the air cylinder as the air cylinder moves downward by the force of the spring 34. This in turn shifts the entire linkage system in the opposite direction, thus disengaging the clutch mechanism and stopping the motor power to the drive shaft 1.

Figure 9:
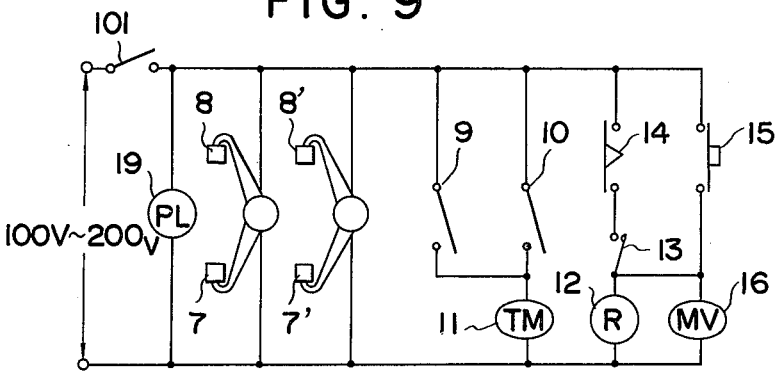
FIG. 9 is schematic circuit diagram of the present invention.

The operation of the winding apparatus will now be described in relation to the electric circuit diagram shown in FIG. 9. Electric power is shown in FIG. 9 as a power source between 100 to 200 volts, although the voltage requirements can vary depending upon the particular design of the motor characteristic. A switch 101 is closed to provide power to the system. When the switch 100 is closed, a circuit through the pilot light 19 is completed, this indicating that the system is ready for operation. A foot switch 15 is positioned adjacent the frame structure in a convenient location for actuation by an operator. Although foot switch 15 is shown, it should be appreciated that other types of switches can be used. When the operator steps on switch 15, power is provided to the solenoid 16 as well as to a relay 12. The relay 12 actuates the contact 13 and thus power is maintained to the solenoid 16 when the operator releases the foot switch 15. As discussed above, the actuation of the solenoid 16 moves the air cylinder rod arrangement in the manner described above, thus providing motor power to the drive shaft 1. The towel is now wound upon the winding shaft 2. During this winding operation, the edges of the towel pass between the photo elements 7, 8, and 7', 8'. Should a rip or tear occur in the towel at its edge portion, or should the towel be folded at its edge portion such that light communication between the light source 7, 7' and the detector 8, 8' is provided, the communication between the light source and the photodetectors provides for a closing of switches 9 or 10, depending upon which photocell system has detected the folded portion of the towel about its side edge. Actuation of the contacts 9 or 10 provides power to a timer 11. If the timer is permitted to keep its predetermined time cycle, that is, if the folded portion of the towel is of a sufficient predetermined length, at the completion of the timer cycle, the delay contact 14 is opened. The opening of delay contact 14 removes the power from the solenoid 16, and thus the cluth motor is disengaged from the pulley arrangement 24. Thus, ths machine is automatically stopped so that an operator can make the necessary correction, such as straightening of the towel. To begin operation after the towel is straightened, the operator merely has to step on foot switch 15 to begin the cycle.

The above represents a preferred embodiment of the invention but it should be appreciated to one of ordinary skill in the art that numerous embodiments and modifications will be apparent without departing from the scope of the present invention.

What I claim is:

1. An automatic winding machine for winding a towel in a roll comprising a machine frame, a towel winding shaft rotatably and horizontally mounted in an upper portion of said frame, drive shaft means rotatably and horizontally mounted in an upper portion of said frame and adjacent said towel winding shaft for rotating the towel winding shaft, motor means for rotating said drive shaft means, a friction cylinder rotatably and horizontally mounted in an upper portion of said frame and adjacent the drive shaft means, holding means for frictionally holding a towel on the periphery of said friction cylinder, said holding means comprising an upper holding bar, moving means for moving said upper holding bar into engagement with said friction cylinder, said moving means comprising an arm lever pivotally interconnected with said frame, whereby movement of said arm lever moves the upper holding bar to force a towel to be wound into frictional engagement with the friction cylinder, detecting means for detecting a folded or torn portion of a towel at a side edge of a towel, said detecting means comprising a pair of photodetecting means each mounted adjacent opposite sides of the frame, each said photodetecting means comprising a light source in communication with a photocell detecting element, whereby the side edges of a towel to be wound pass between the photodetecting element and the light source, actuating means for actuating said motor means, and stopping means for stopping said motor means when said detecting means detects a folded or torn portion of a towel.

2. An automatic winding machine for rolled towels as claimed in claim 1 wherein said holding means further comprises a lower holding bar substantially parallel to said upper holding bar, and wherein said moving means further comprises means for moving said lower holding bar into engagement with a towel to be wound, whereby movement of said arm lever of said moving means moves the lower holding member into engagement with a towel to be wound.

3. An automatic winding machine for rolled towels as claimed in claim 2 wherein said upper holding bar is substantially parallel to the major axis of said friction cylinder and positioned below said friction cylinder, said detecting means positioned below said holding bar, said lower holding bar positioned below said detector means whereby movement of said arm lever moves the upper and lower holding bars so that a towel to be wound tightly engages the friction cylinder, and is tightly stretched between the light source and the photodetecting element.

4. An automatic winding machine for rolled towels as claimed in claim 1 wherein said stopping means comprises a timing relay, means for providing electrical power to said timing relay when said detecting means detects a folded or torn portion of a towel, means for disabling said actuating means comprising a delay contact whereby said timing relay opens said delay contact after a predetermined time.

5. An automatic winding machine for rolled towels as claimed in claim 1 wherein said actuating means comprises an electromagnetic valve, a source of electrical power, means for connecting said source of electrical power to said electromagnetic valve comprising a foot switch, and retaining means for retaining electrical power to said electromagnetic valve when said foot switch is released, said retaining means comprising a relay and a retaining contact actuated by said relay, whereby actuation of said electromagnetic valve actuates the interconnecting means.

6. An automatic winding machine for rolled towels as claimed in claim 5 wherein said motor means comprises a clutch wherein actuation of said interconnecting means causes engagement of said clutch to connect said motor means to said drive means.

* * * * *